US009386848B2

(12) United States Patent
Holzapfel

(10) Patent No.: US 9,386,848 B2
(45) Date of Patent: Jul. 12, 2016

(54) FIXING DEVICE WITH SPACER

(71) Applicant: Julius Blum GmbH, Hoechst (AT)

(72) Inventor: Andreas Holzapfel, Bregenz (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 14/282,149

(22) Filed: May 20, 2014

(65) Prior Publication Data

US 2014/0252936 A1 Sep. 11, 2014

Related U.S. Application Data

(63) Continuation of application No. PCT/AT2012/000267, filed on Oct. 29, 2012.

(30) Foreign Application Priority Data

Nov. 22, 2011 (AT) ..... A 1726/2011

(51) Int. Cl.
*A47B 88/00* (2006.01)

(52) U.S. Cl.
CPC ..... *A47B 88/0051* (2013.01); *A47B 88/0055* (2013.01); *A47B 2088/0059* (2013.01)

(58) Field of Classification Search
CPC ..... A47B 2088/0059; A47B 2088/0062; A47B 2088/0066; A47B 2088/007; A47B 88/0055; A47B 88/0051; Y10T 292/1047
USPC ..... 312/348.4, 348.2
See application file for complete search history.

(56) References Cited

U.S. PATENT DOCUMENTS

| | | | | |
|---|---|---|---|---|
| 5,540,515 | A | 7/1996 | Röck et al. | |
| 5,860,718 | A * | 1/1999 | Brustle | 312/348.2 |
| 6,457,791 | B1 * | 10/2002 | Muterthies et al. | 312/348.4 |
| 6,757,937 | B2 | 7/2004 | Salice | |

(Continued)

FOREIGN PATENT DOCUMENTS

| | | |
|---|---|---|
| CN | 1496693 | 5/2004 |
| CN | 2762650 | 3/2006 |

(Continued)

OTHER PUBLICATIONS

International Search Report (ISR) issued Jan. 30, 2013 in International (PCT) Application No. PCT/AT2012/000267.

(Continued)

*Primary Examiner* — Daniel J Troy
*Assistant Examiner* — Andres Gallego
(74) *Attorney, Agent, or Firm* — Wenderoth, Lind & Ponack, L.L.P.

(57) ABSTRACT

A fixing device for fixing a front panel on a drawer includes a furniture fitting which is preassembled on the front panel. The furniture fitting has at least one connecting piece which projects from the front panel and a pin which runs transverse to the connecting piece. A catching device is associated with the drawer. The catching device automatically retains the furniture fitting when the furniture fitting is inserted, and the catching device has a movable spring-loaded catching element which is triggered by the pin and which retains the pin. The catching element is moved along a guiding plate. A deflecting element is provided on a guiding plate face near the front panel for deflecting the furniture fitting which is preassembled in the front panel. The deflecting element is formed as a projection which projects laterally.

26 Claims, 14 Drawing Sheets

(56) References Cited

U.S. PATENT DOCUMENTS

| | | | |
|---|---|---|---|
| 8,038,234 | B2 | 10/2011 | Weber |
| 2007/0228906 | A1 | 10/2007 | Netzer |
| 2009/0113673 | A1 | 5/2009 | Weber |
| 2010/0102692 | A1 | 4/2010 | Hämmerle |

FOREIGN PATENT DOCUMENTS

| | | |
|---|---|---|
| DE | 10 2007 011 037 | 10/2007 |
| DE | 20 2007 015 212 | 1/2008 |
| DE | 10 2007 053 637 | 5/2009 |
| EP | 0 636 327 | 2/1995 |
| EP | 2 374 370 | 10/2011 |
| RU | 2 381 731 | 2/2010 |
| RU | 2008133651 | 2/2010 |
| WO | 2009/006651 | 1/2009 |
| WO | 2009/059652 | 5/2009 |
| WO | 2010/115346 | 10/2010 |

OTHER PUBLICATIONS

Austrian Patent Office Search Report (ASR) issued Jun. 26, 2012 in Austrian Patent Application No. A 1726/2011.

* cited by examiner

FIG. 4a
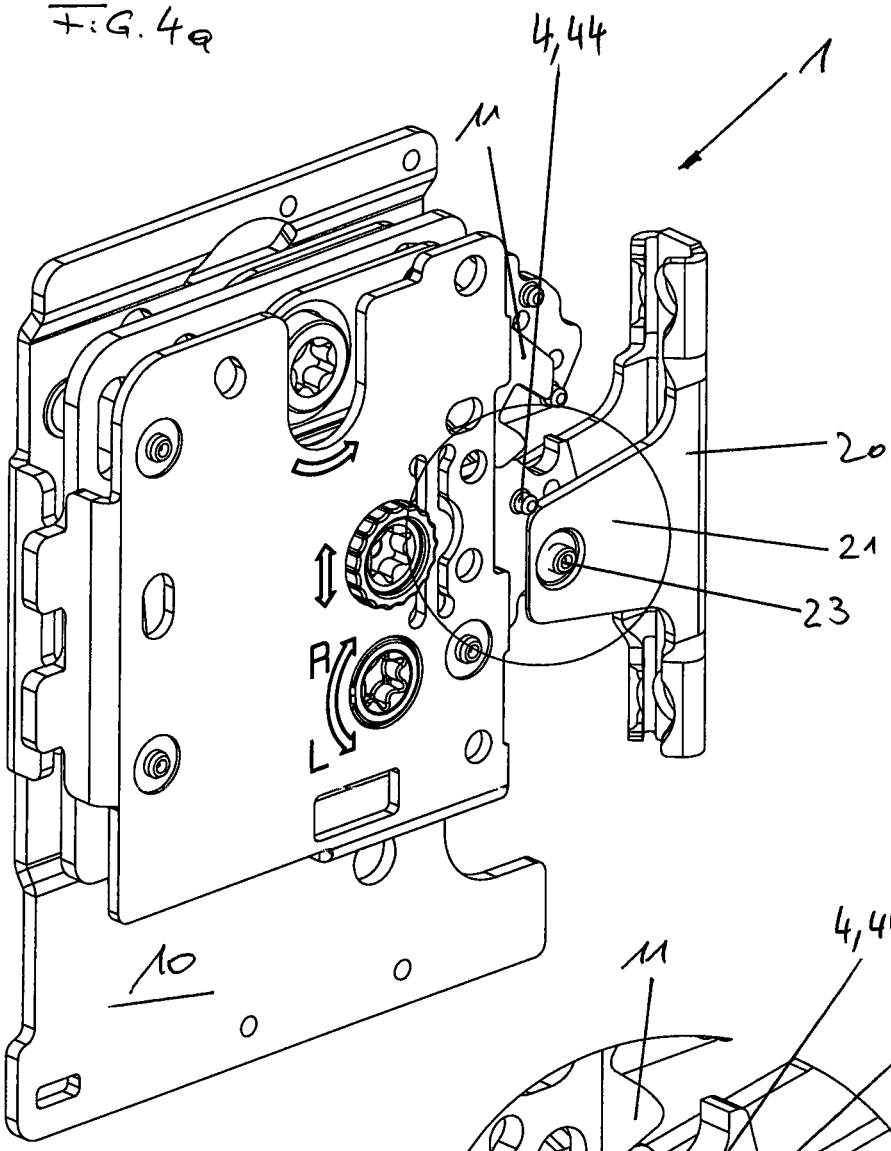
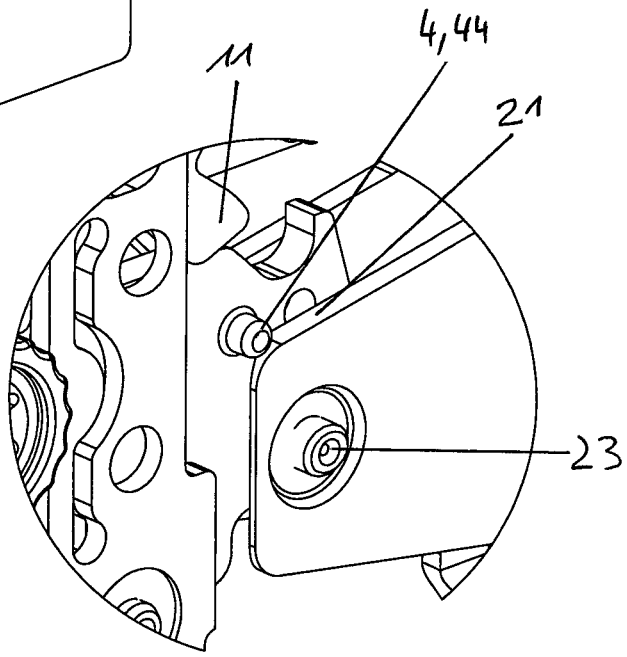
FIG. 4b

Stand der Technik
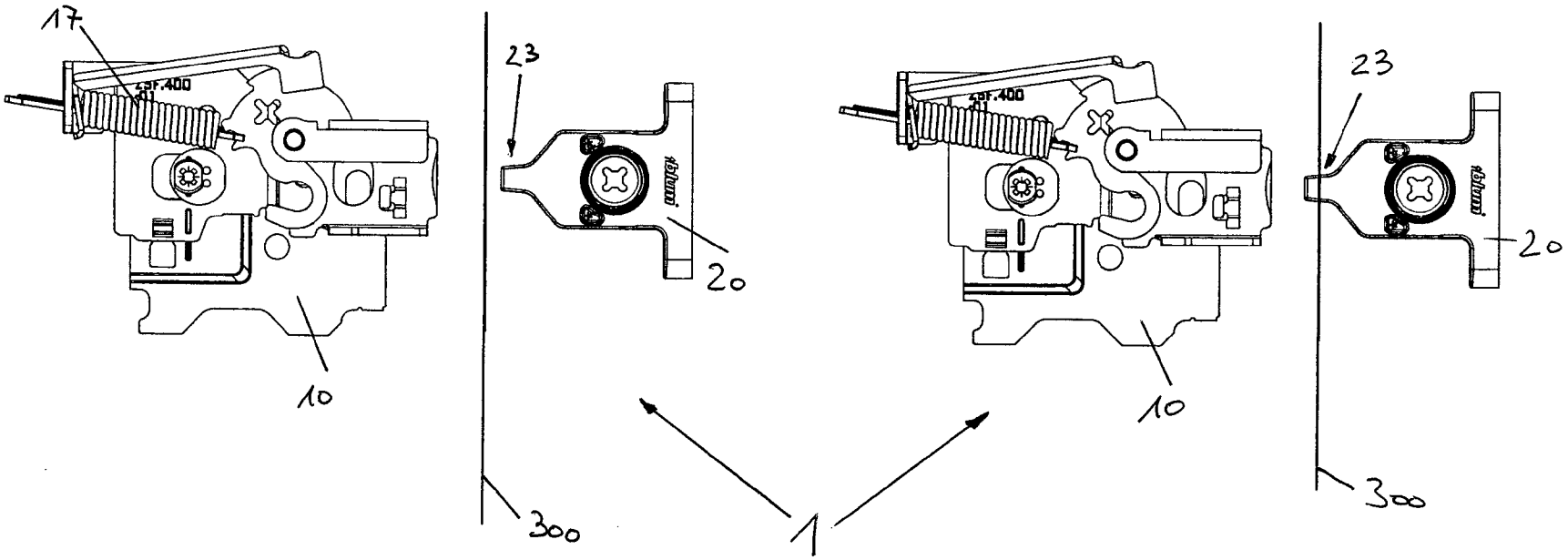

Stand der Technik

Stand der Technik
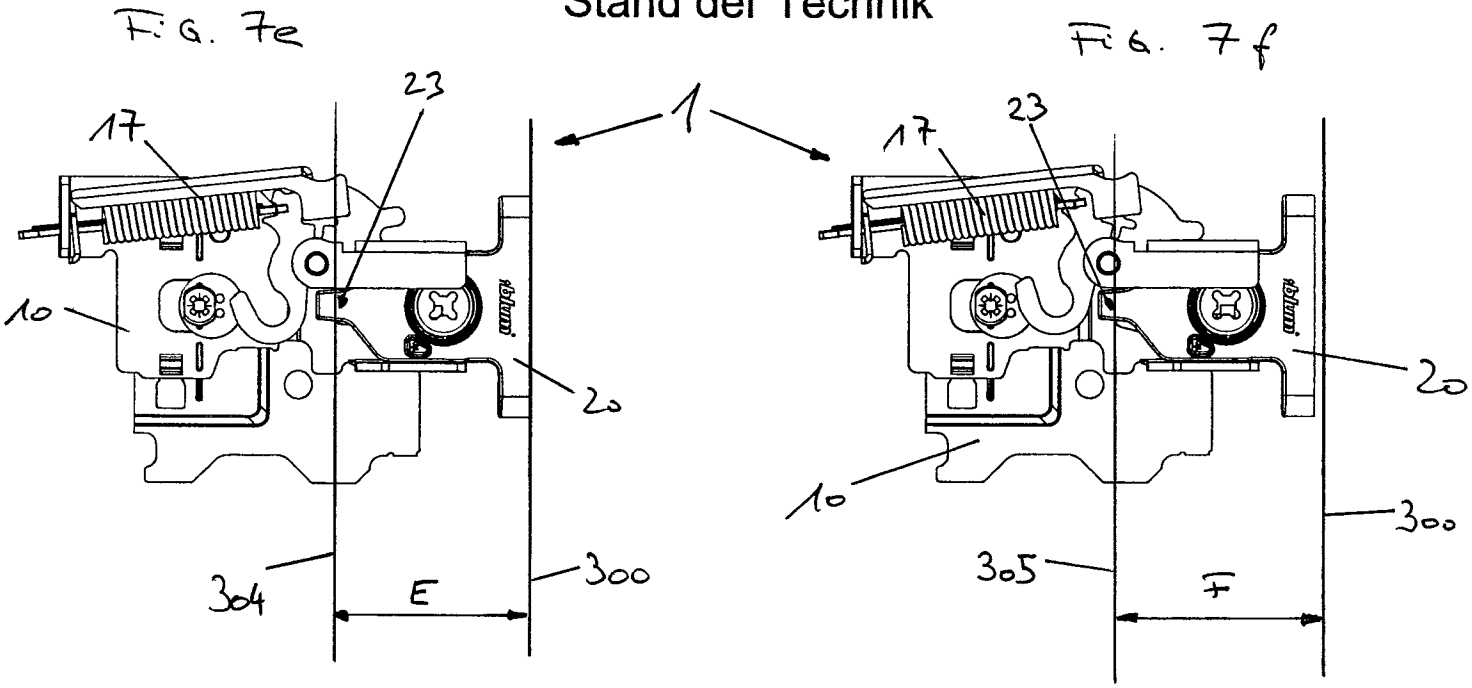

1
10
11
16
17
20
23
A
200
203
204
D
E

FIXING DEVICE WITH SPACER

BACKGROUND OF THE INVENTION

The invention concerns a fixing device for fixing a front panel to a drawer, in particular to a drawer side wall. The device includes at least one furniture fitting pre-mounted to the front panel, with the furniture fitting having at least one leg projecting from the front panel, and a pin extending transversely relative to the leg. A catch device is associated with the drawer, and when the furniture fitting is pushed in the catch device, the catch device automatically holds the furniture fitting. The catch device has a movable spring-loaded catch element which can be triggered by the pin and holds the pin, and the catch element is movable along a guide plate.

The invention further concerns a drawer side wall having such a fixing device, a drawer having such a drawer side wall, and an article of furniture having at least one such drawer.

Fixing devices for fixing a front panel to a drawer are known in large numbers from the state of the art. Those fixing devices serve for fast assembly of the drawer and in the normal case are of such a design configuration that they can also be released again to disassemble the drawer again. A disadvantage which often arises in that case is that erroneous triggering of the catch devices can occur, where the pin of the furniture fitting is not yet accommodated in the catch element of the catch device.

SUMMARY OF THE INVENTION

The object of the invention is to provide a fixing device for fixing a front panel to a drawer, which is improved over the state of the art.

Provided on the guide plate is at least one deflection element against the furniture fitting pre-mounted in the front panel, and the deflection element is in the form of a laterally projecting projection—preferably in the form of a knob. Therefore, it is possible to prevent erroneous triggering of the catch device as the pre-mounted furniture fitting is deflected by the deflection element and thus the furniture fitting—more specifically its leg or legs—cannot trigger the spring-loaded catch element.

Preferably, the laterally projecting projection has a height which is at least as great as a thickness of the catch element.

It is particularly preferred in that respect that the height of the laterally projecting projection together with a width of the guide plate is at least as great as an internal space width of the furniture fitting.

It has proven to be particularly advantageous if the deflection element is in the form of a nose.

Particularly preferably, at least two—preferably three and more—deflection elements are provided on the guide plate.

In a preferred embodiment, at least two deflection elements are in the form of a nose and at least two—preferably three and more—deflection elements are in the form of laterally projecting projections—preferably knobs.

In addition, preferably the catch element is plate-shaped and parallel to the guide plate and preferably slides along the guide plate.

It has proven to be particularly advantageous if the catch element has a catch opening at its free end.

In a preferred embodiment, the catch element is mounted pivotably about an axis of rotation.

It has found to be particularly advantageous if the fixing device has two catch elements which are plate-shaped and parallel to the guide plate and which preferably slide at both sides along the guide plate.

In that respect, particularly preferably the at least two—preferably three or more—deflection elements are provided at both sides on the guide plate.

In that respect, it is particularly preferable if the overall height of projections projecting at both sides on the guide plate together with the width of the guide plate is at least as great as the internal space width of the furniture fitting.

In that respect it has proven to be particularly advantageous if the fixing device has an unlocking device for the catch device, which fixing device permits intended release of the furniture fitting from the catch device. The unlocking device releases the catch element and the pin of the furniture fitting.

In a preferred embodiment, the unlocking device has a tool receiving means for a tool, which is accessible from outside and by way of which the unlocking device is actuable.

It has further proven to be advantageous if the fixing device has a height adjusting device and/or a lateral adjusting device for the furniture fitting on the front panel.

It has been found to be advantageous if a spacing of a free end of the leg of the furniture fitting from a rear side of the furniture fitting, that is towards the front panel, is greater than a spacing of the pin of the furniture fitting from the rear side of the furniture fitting, that is towards the front panel.

Furthermore, a drawer side wall can have at least one fixing device for fixing a front panel to a drawer by at least one of the described embodiments.

It has been found to be particularly advantageous if a latching position, in which the pin of the furniture fitting latches in a latching receiving means of the catch device, is at a spacing relative to the front edge of the drawer side wall, that is less than 15 mm—preferably less than 10 mm.

Particularly preferably, a latching travel from the front edge of the drawer side wall to the latching position is less than 15 mm—preferably less than 10 mm.

In that respect it has been found to be particularly advantageous if an introduction position, in which the pin of the furniture fitting is in the catch opening of the catch element of the catch device, is at a spacing relative to the front edge of the drawer side wall, that is less than 25 mm—preferably less than 10 mm.

In a preferred embodiment, an introduction travel from the front edge (200) of the drawer side wall (100) to the introduction position (202) is less than 25 mm—preferably less than 10 mm.

It has further proven to be advantageous if a triggering position, in which the pin of the furniture fitting triggers the catch element of the catch device, is at a spacing relative to the front edge of the drawer side wall, that is less than 25 mm—preferably less than 15 mm.

It has been found to be advantageous if a triggering travel from the introduction position to the triggering position is greater than 1.5 mm—preferably greater than 2.5 mm.

In addition, preferably a closure position in which the pin of the furniture fitting was pulled by the catch element of the catch device into the catch device is at a spacing relative to the front edge of the drawer side wall, that is less than 30 mm—preferably less than 20 mm.

It has proven to be particularly advantageous if a closure travel from the triggering position to the closure position is greater than 6 mm—preferably greater than 7 mm.

Particularly preferably, a closure reserve position, in which the pin of the furniture fitting is pulled by the catch element of the catch device into the catch device beyond the closure position into the catch device, is at a spacing relative to the front edge of the drawer side wall, that is less than 30 mm—preferably less than 20 mm.

In that respect it has been found to be particularly advantageous if a closure reserve travel from the closure position to the closure reserve position is less than 2 mm—preferably less than 1 mm.

In addition, a drawer can have at least one drawer side wall as set forth in at least one of the described embodiments.

Specifically, protection is also claimed for an article of furniture having at least one drawer with a fixing device as set forth in one of the described embodiments.

BRIEF DESCRIPTION OF THE DRAWINGS

Further details and advantages of the present invention are described more fully hereinafter by the specific description with reference to the embodiments illustrated in the drawings, in which:

FIG. 4*a* shows a perspective view of a fixing device in which the furniture fitting is against a deflection element, FIG. 4*b* shows a detail view of FIG. 4*a*, FIGS. 7*a*-7*f* show plan views of the fixing operation at different positions of the furniture fitting relative to the catch device according to the state of the art.

DETAILED DESCRIPTION OF THE INVENTION

Figure 1B:
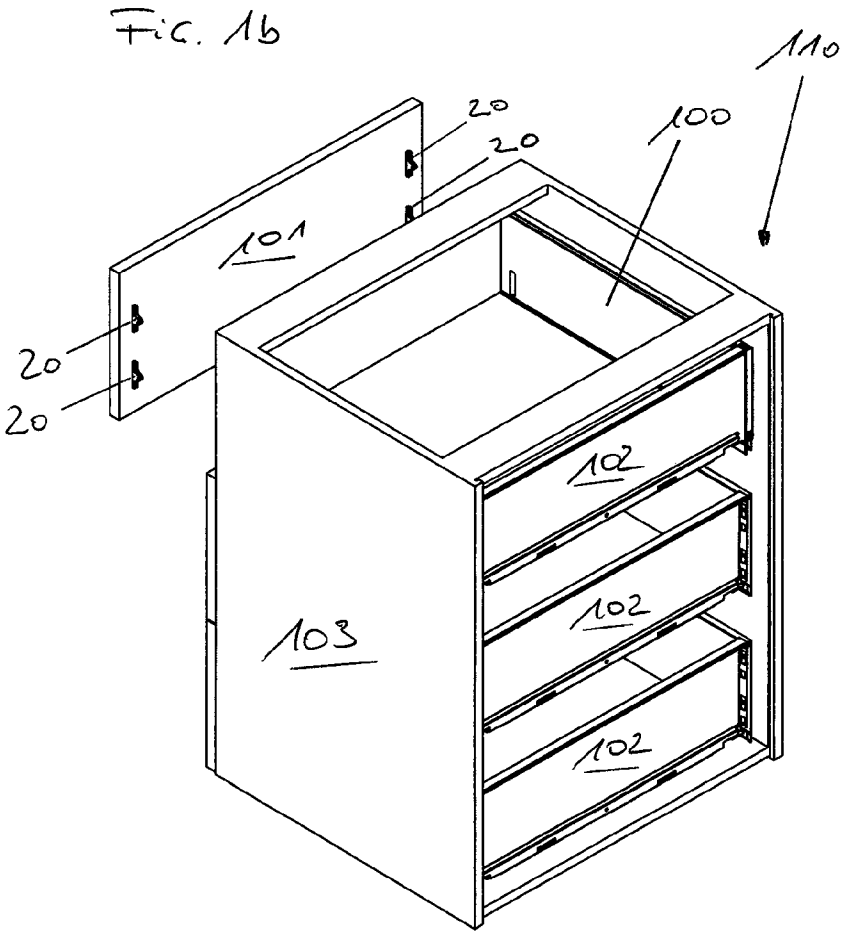
FIGS. 1*a*, 1*b* show a perspective view of an article of furniture with drawers.
Figure 1A:
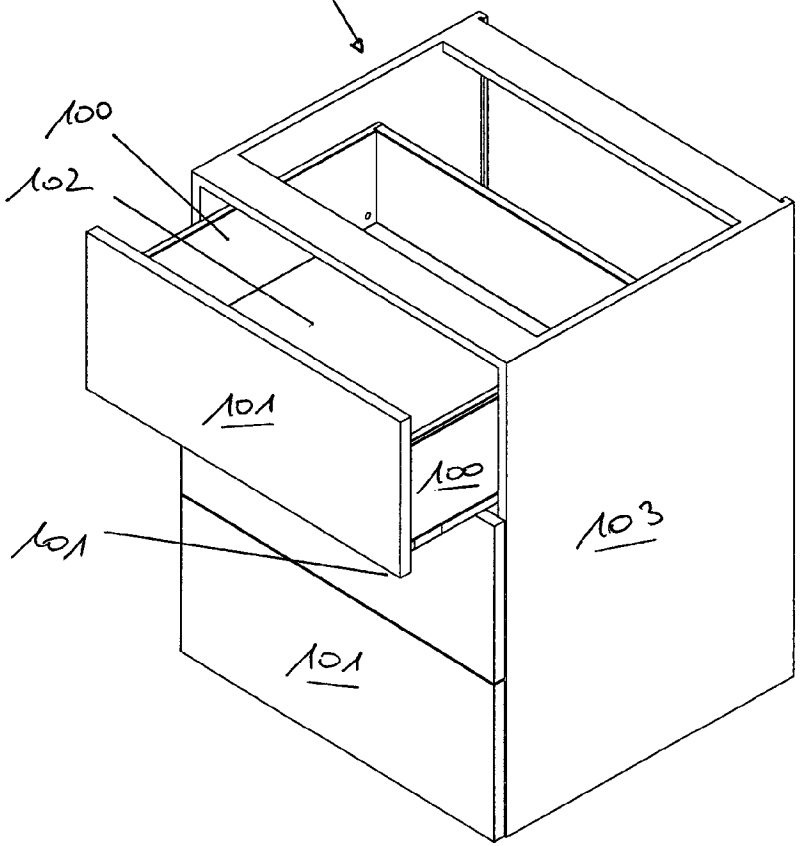

FIG. 1*a* shows a perspective view of an article of furniture 110. In this case, the article of furniture 110 has a furniture carcass 103 and three drawers 102. The drawers 102 in turn have drawer side walls 100 and front panels 101 fixed thereto. In this arrangement, the front panels 101 were fixed to the drawer side walls 100 of the drawer 102 by way of fixing devices (not shown here).

FIG. 1*b* shows the article of furniture 110 as shown in FIG. 1*a*, wherein the uppermost front panel 101 has not yet been fixed to the drawer 102 or its two drawer side walls 100.

In this embodiment, it is possible to see, on the front panel 101, four pre-mounted furniture fittings 20, by way of which the front panel 101 is fixed to the drawer side walls 100.

Figure 2A:
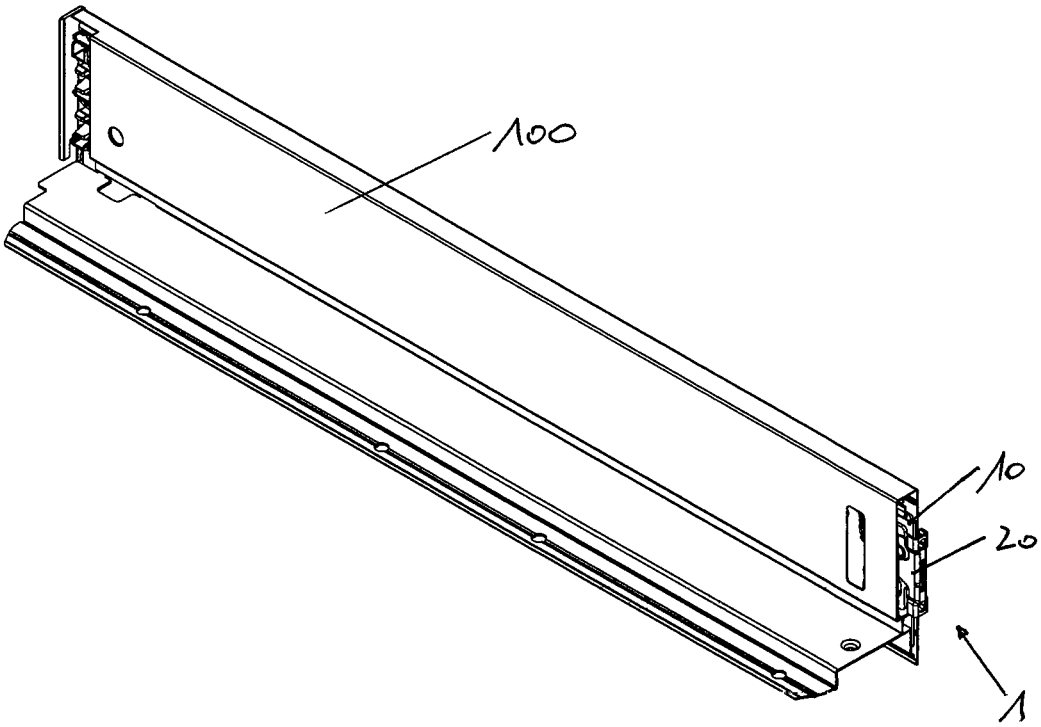
FIGS. 2*a*, 2*b* show a perspective view of a drawer side wall.
Figure 2B:
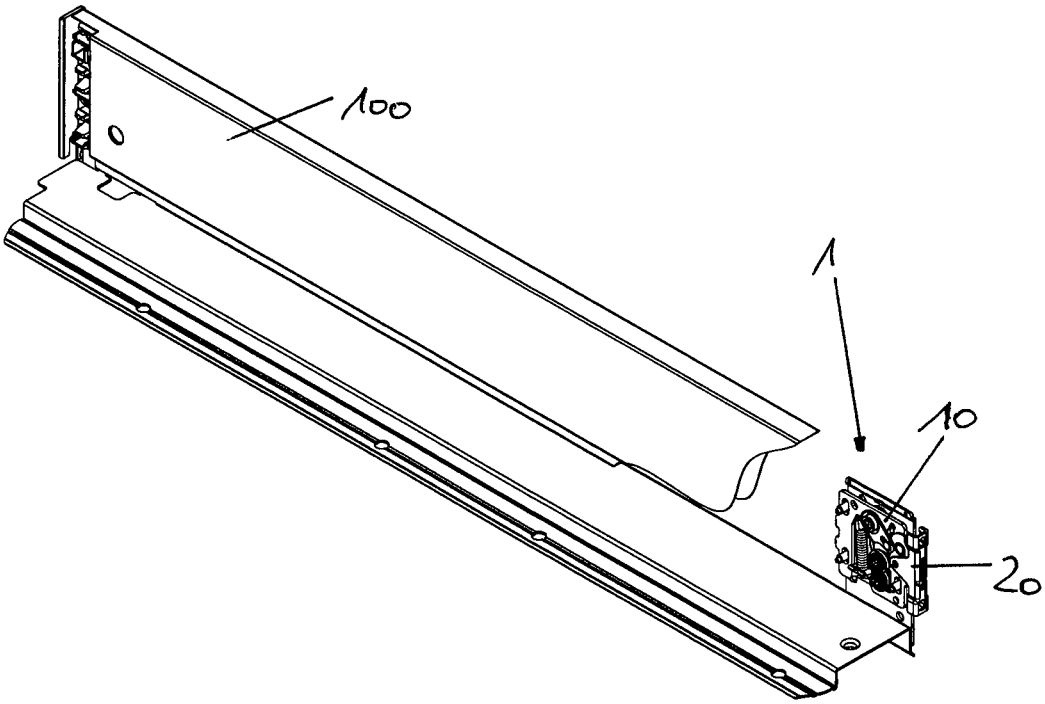

FIGS. 2*a* and 2*b* show perspective views of a drawer side wall 100 with a fixing device 1 arranged therein. In this case, provided in the drawer side wall 100, is the catch device 10 which catches the furniture fitting 20 and thus connects the front panel 101 (not shown here) to which the furniture fitting 20 is normally pre-mounted to the drawer side wall 100.

Figure 3A:
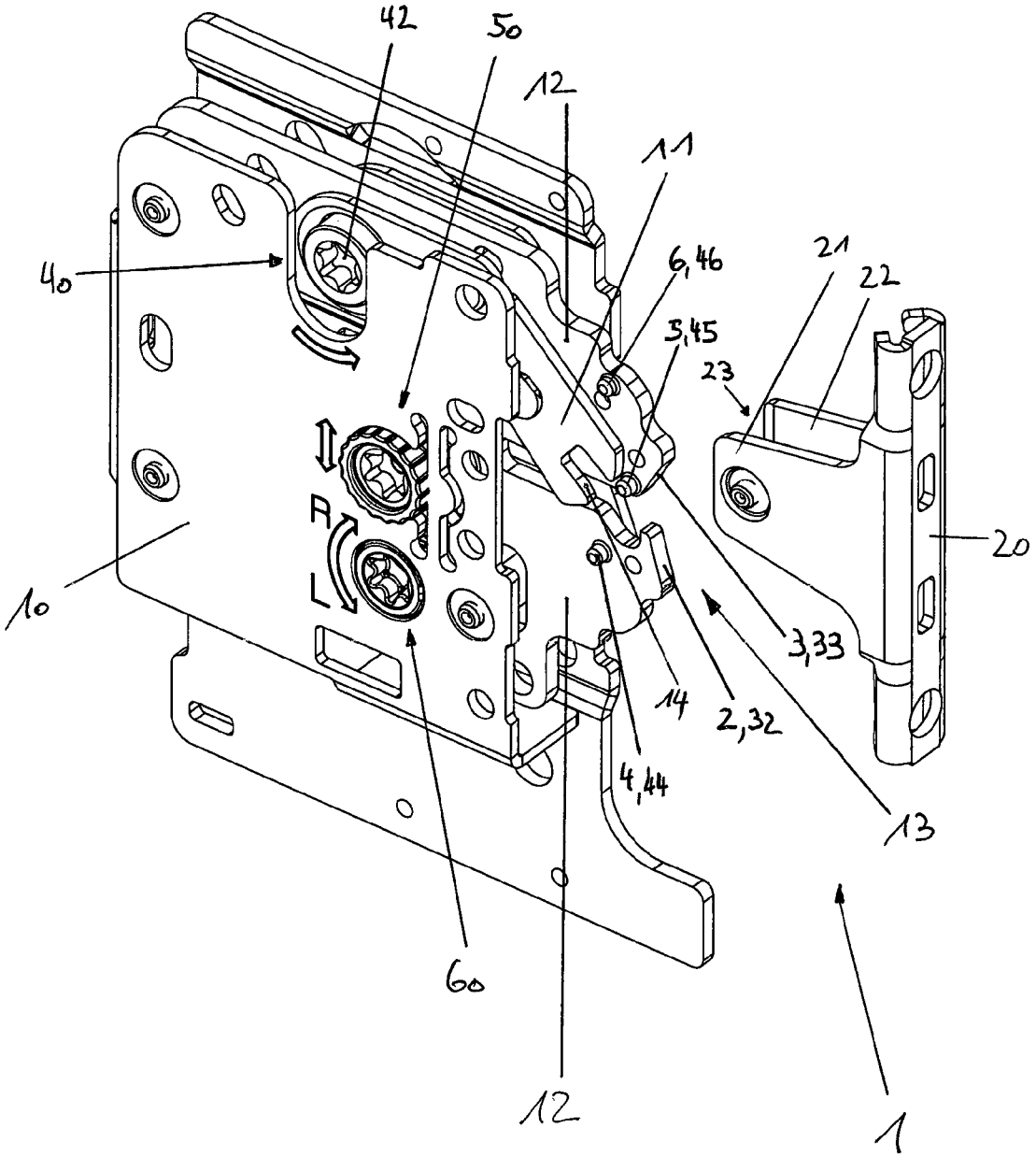
FIG. 3*a* shows a perspective view of a fixing device.

FIG. 3*a* shows a perspective view of the fixing device 1 comprising the catch device 10 which is usually mounted in a drawer side wall 100 (not shown here) and the furniture fitting 20 which is usually fixed pre-mounted to a front panel 101 (not shown here).

To align the front panel 101, the catch device 10 has a height adjusting device 50 and a lateral adjusting device 60.

To unlock an already fixed furniture fitting 20 from the catch device 10, the catch device 10 has an unlocking device 40 which permits intentional release of the furniture fitting 20 from the catch device 10, in which case the unlocking device 40 releases the catch element 11 of the catch device 10 and thereby the pin 23 of the furniture fitting 20. In this preferred embodiment, the unlocking device 40 is provided with a tool receiving element 22 which is accessible from the outside, whereby the unlocking device 40 can be actuated by a tool.

The fixing device 1 for fixing a front panel 101 to a drawer 102, in particular to a drawer side wall 100, has in this embodiment at least one furniture fitting 20 which is pre-mounted to the front panel 101. The furniture fitting 20 has at least one leg 21 and 22 projecting from the front panel 101, and a pin 23 extending transversely relative to the leg 21 or 22 respectively and a catch device 10 associated with the drawer 102 (not shown). The catch device 10 automatically holds the furniture fitting 20 when it is pushed in, and the catch device 10 has a movable spring-loaded catch element 11 which can be triggered by the pin 23 and which holds the pin 23. The catch element 11 is movable along a guide plate 12, wherein provided at a side 13 of the guide plate 12, that is associated with the front panel 101, there is at least one deflection element 2—in this preferred embodiment a plurality of deflection elements 2, 3, 4, 5, 6, 7, 8 and 9—against the furniture fitting 20 pre-mounted in the front panel 101.

In this preferred embodiment, two deflection elements 2 and 3 are in the form of noses 32 and 33 and permit easier introduction of the furniture fitting 20 or the pin 23 of the furniture fitting 20 into the catch device 10.

The further deflection elements 4, 5, 6 (or 7, 8 and 9, see FIG. 3*b*) are in this case in the form of laterally projecting projections 44, 45, 46, 47, 48, 49.

In this preferred embodiment, the laterally projecting projections 44, 45, 46, 47, 48, 49 are also in the form of knobs. It will be appreciated that the laterally projecting projection 44, 45, 46, 47, 48, 49 are in the form of legs or the like. The only important consideration in that respect is that they project laterally from the guide plate 12 and thus can prevent erroneous triggering of the catch element 11 by the legs 21 and 22 of the furniture fitting 20—which would occur if the furniture fitting 20 is not fitted accurately into the catch device 10 (see in that respect FIGS. 4*a* and 4*b* and FIGS. 5*a* and 5*b*).

To exclude erroneous triggering of the catch element 11, the laterally projecting projections 44, 45, 46, 47, 48, 49 are of a height which is at least as great as the thickness of the flat, plate-shaped catch element 11.

In this embodiment, the plate-shaped catch element 11 is parallel to the guide plate 12 and slides along the guide plate 12.

In this case, in the front region the catch element 11 has a catch opening 14 at its free end, into which the pin 23 of the furniture fitting 20 is introduced.

In this preferred embodiment, there are two catch elements 11 and 11' (catch element 11', see FIG. 3*b* and FIG. 6 respectively) which can slide at both sides along the guide plate 12. To prevent erroneous triggering at both sides, therefore, the laterally projecting projections 44, 45, 46, 47, 48, 49 are also provided at both sides on the guide plate 12 and can thus prevent the legs 21 and 22 of the furniture fitting 20 from coming into contact with the catch elements 11 and 11', which prevents erroneous triggering.

Figure 3B:
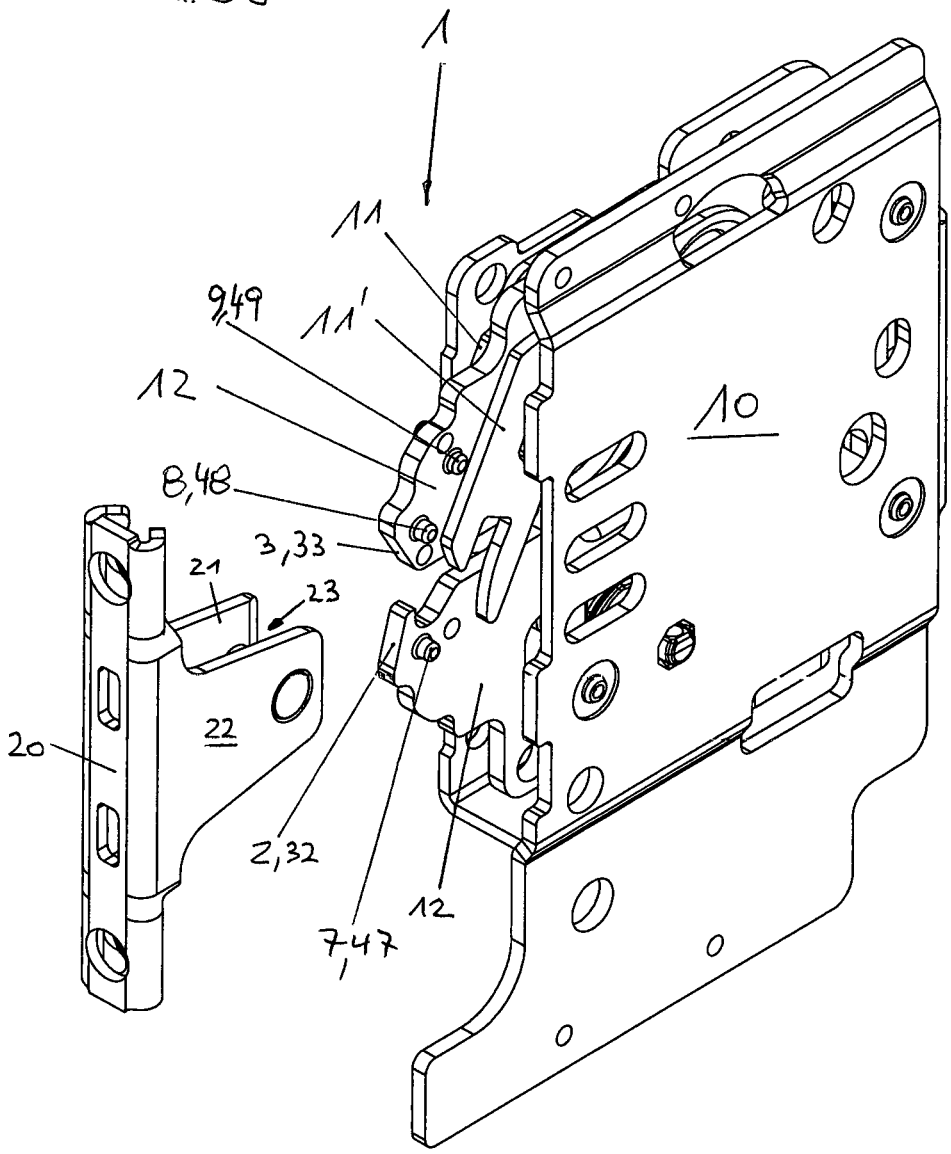
FIG. 3*b* shows a further perspective view of the fixing device of FIG. 3*a*.

FIG. 3*b* shows a further perspective view of the fixing device as shown in FIG. 3*a*. It is now possible to see the second catch element 11' at that rear side. So that no incorrect triggering of the spring-loaded catch element 11' by the legs 21 or 22 of the furniture fitting 20 can occur, the guide plate 12 carries the three deflection elements 7, 8 and 9 which in this preferred embodiment are in the form of laterally projecting projections 47, 48 and 49. Otherwise the foregoing description relating to FIG. 3*a* also correspondingly applies here.

FIG. 4*a* and its detail view of FIG. 4*b* show perspective views of how the deflection element 4 can prevent erroneous triggering of the catch element 11 by the leg 21 of the furniture fitting 20, insofar as the leg 21 is against the deflection element 4 which in this preferred embodiment is in the form of a laterally projecting projection 44. Thus, the leg 21 cannot pass behind the deflection element 4 and as a result, contact in relation to the catch element 11 by the leg 21 can be prevented.

Thus, erroneous triggering by the furniture fitting 20 from below in the direction of the catch element 11 is not possible.

Figure 5A:
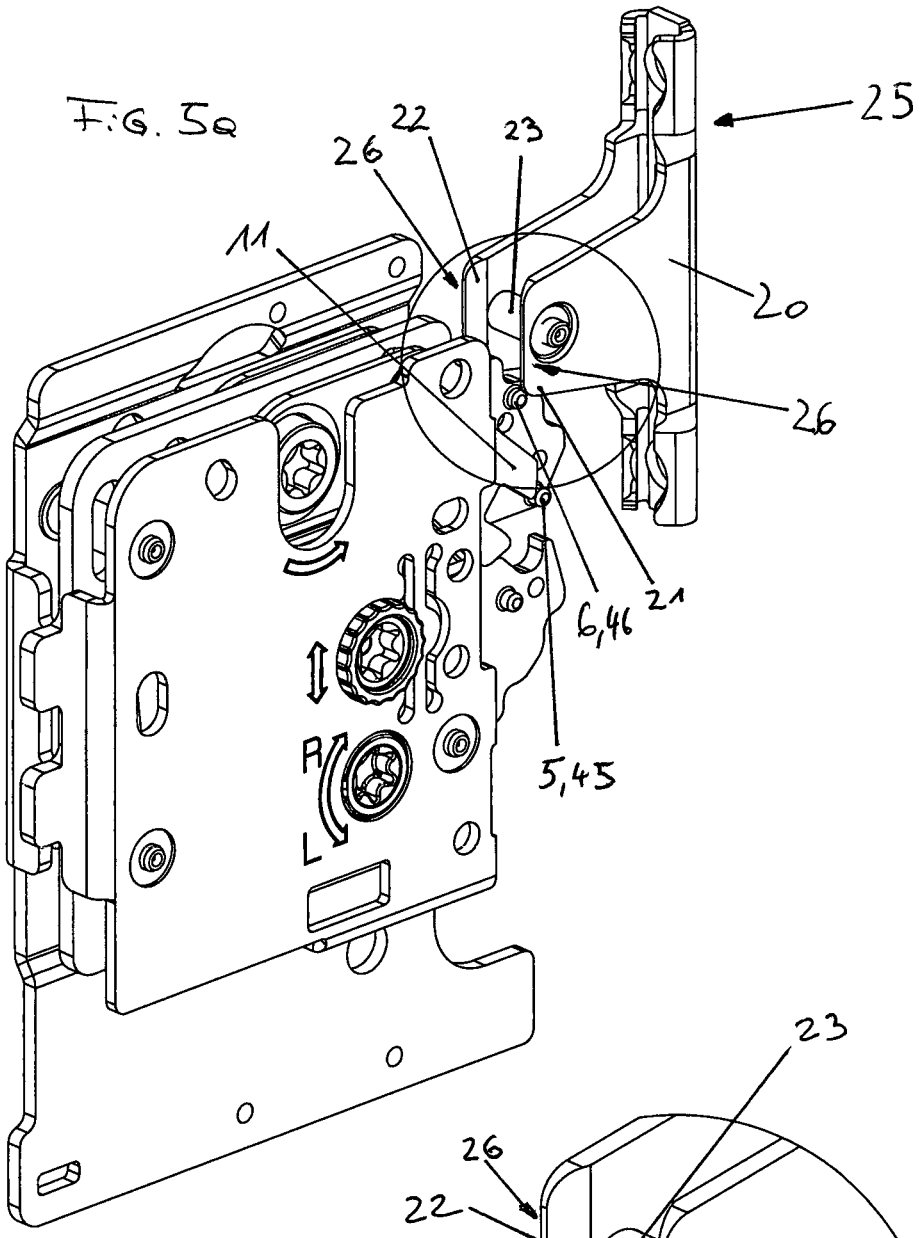
FIG. 5*a* shows a perspective view of a fixing device in which the furniture fitting is against a further deflection element.
Figure 5B:
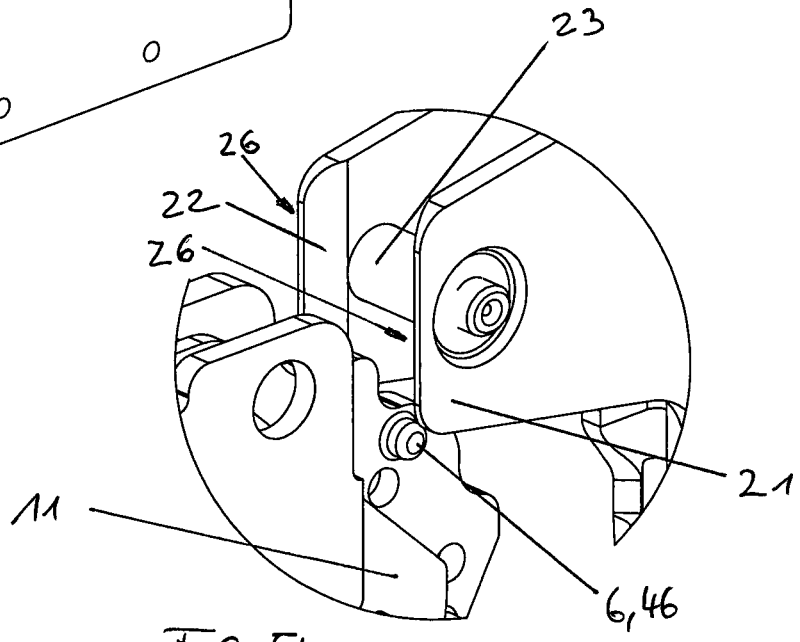
FIG. 5*b* shows a detail view of FIG. 5*a*.

FIG. 5*a* and its detail view in FIG. 5*b* show perspective views illustrating how the deflection element 6 prevents erroneous triggering by the furniture fitting 20 from above as the leg 21 of the furniture fitting cannot move past the deflection element 6 which is in the form of a laterally projecting projection 46. Thus, the leg 21 cannot touch the catch element 11.

In this view of the furniture fitting 20, it can be clearly seen that the spacing of the free end 26 of the legs 21 and 22 from the rear side 25 of the furniture fitting 20, that is (i.e., towards the front panel) is greater than the spacing of the pin 23 from the rear side 25 of the furniture fitting, that is towards the front panel. This provides that the legs 21 and 22 penetrate into the catch device 10 further than the pin 23. That is a reason why erroneous triggering effects by the legs 21 and 22 can occur as they penetrate into the catch device 10 before the pin 23.

A further reason why erroneous triggering effects can be avoided is that the overall height of two projections 44, 45, 46, 47, 48, 49 projecting on both sides from the guide plate 11 together with the width of the guide plate 11 is at least as great as the internal space width of the furniture fitting 20. As a result, the furniture fitting 20 cannot move past the projecting projections 44, 45, 46, 47, 48, 49. In this embodiment, the internal space width of the furniture fitting 20 substantially corresponds to the length of the pin 23, and the space extends from one leg 21 to the other leg 22.

It will be appreciated that, in a further embodiment, it would also be conceivable that laterally projecting projections would be provided only on one side of the guide plate 12, then it would be precisely the height of one of the laterally projecting projections together with the width of the guide plate 12 that is at least as great as the internal space width of the furniture fitting 20 in order to prevent erroneous triggering.

The deflection element 5—in the form of a laterally projecting projection 45—is intended to prevent erroneous triggering by a straight furniture fitting 20—that is to say which is introduced horizontally—(this is not shown).

Figure 6:
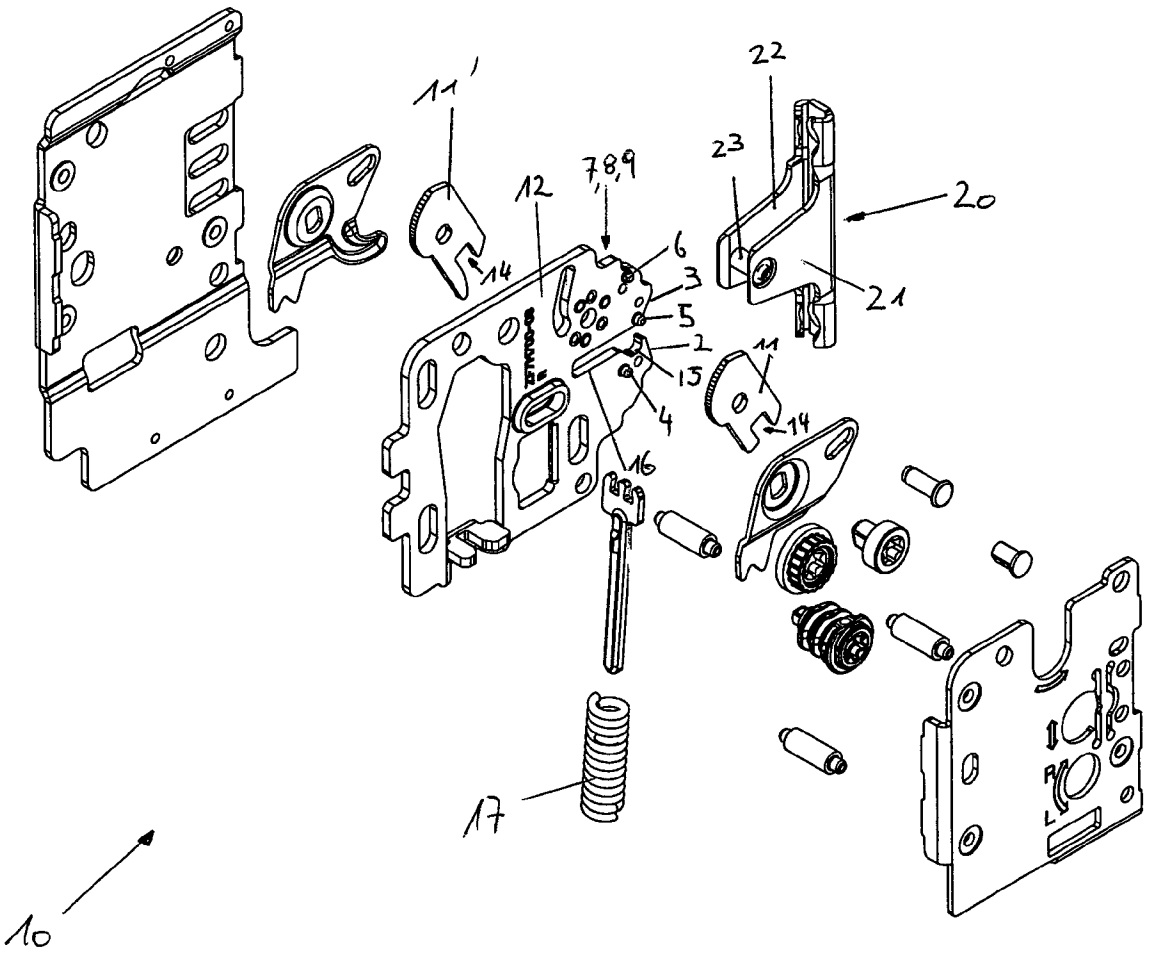
FIG. 6 shows a perspective exploded view of a fixing device.

FIG. 6 shows a perspective exploded view of the catch device 10 and a perspective view of the furniture fitting 20. Here, it is now possible to clearly see the two catch elements 11 and 11'—spring-loaded by way of the spring 17—with their catch openings 14, which are arranged at both sides on the guide plate 12 and thus contribute to a stable structure.

Shown on the guide plate 12 are the three deflection elements 4, 5 and 6 which prevent erroneous triggering of the catch element 11 if the pin 23 of the furniture fitting 20 is not correctly introduced into the guide path 16 of the guide plate 12. Provided on the rear side of the guide plate 12 are the three deflection elements 7, 8 and 9 which prevent erroneous triggering of the catch element 11' if the pin 23 of the furniture fitting 20 is not correctly introduced into the guide path 16 of the guide plate 12.

In that case, provided at the beginning of the guide path 16 of the guide plate 12, is a latching opening 15 provided for receiving the pin 23 of the furniture fitting 20 if locking of the fixing device 1 is not wanted. That situation occurs specifically when the furniture fitting 20 is released from the catch device 10 and can thus move into that waiting position, whereupon the front panel can subsequently be removed with the furniture fitting 20 from the drawer (not shown here) (see for that purpose also FIG. 8*c*).

Reference is now made to FIGS. 7*a* through 7*f* to describe the fixing operation of a furniture fitting 20 in a catch device 10 according to the state of the art in order subsequently to set out the differences and advantages of the novel fixing device 1 with reference to FIGS. 8*a* through 8*g*.

FIG. 7*a* shows a furniture fitting 20 which has not yet been introduced into the catch device 10 but which is still disposed with its pin 23 behind the front edge 300 of the side wall of the drawer. That catch device 10 which belongs to the state of the art also has a catch element (not shown) which is spring-loaded by way of a spring 17 and which is intended to catch and lock the pin 23 of the furniture fitting 20.

Figures 7C, 7D:
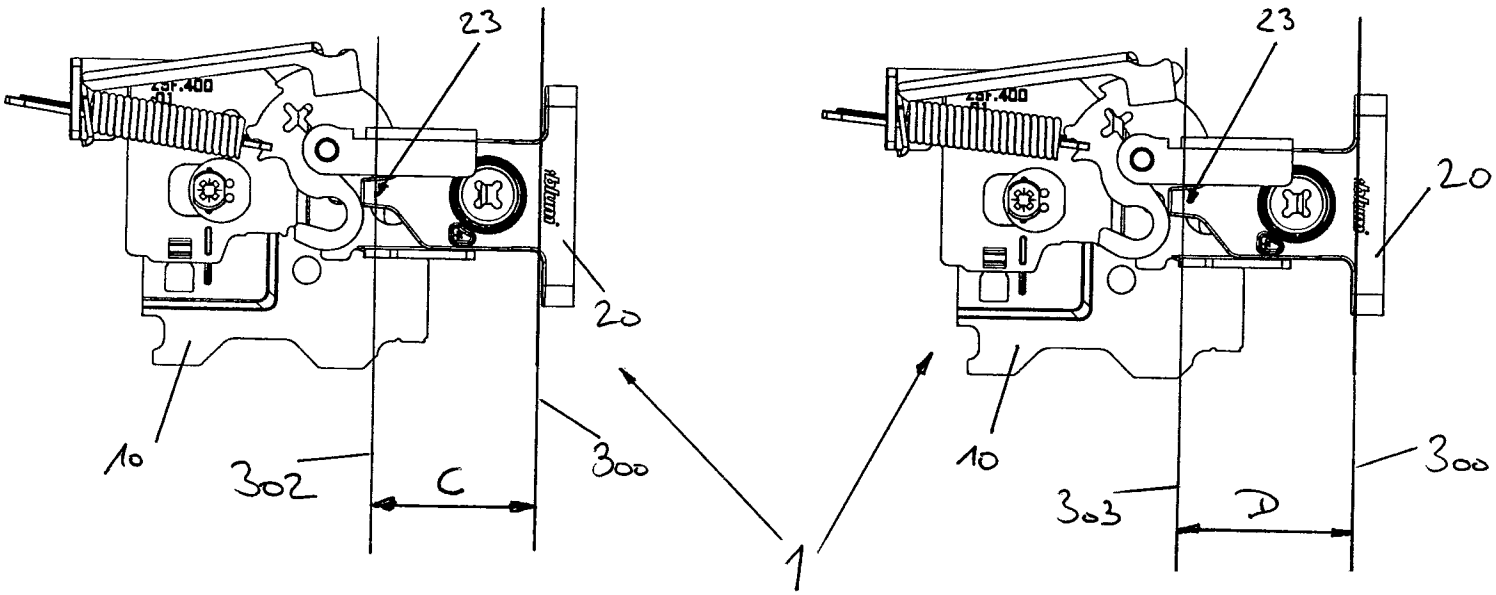

In FIG. 7*b*, the pin 23 of the furniture fitting 20 is at the position of the front edge 300 of the drawer side wall and is now introduced—as shown in FIG. 7*c*—into an introduction passage of the catch device 10—until reaching its introduction position 302. In the fixing device 1 belonging to the state of the art, that introduction position 302 is already at a spacing C relative to the front edge 300 of the drawer side wall of more than 20 mm. In this specific example the distance is 29.8 mm.

The introduction travel—from the front edge 300 of the drawer side wall to the introduction position 302—is 29.8 mm.

A further forward displacement of the pin 23 of the furniture fitting 20 into the introduction passage of the catch device 10 moves the pin 23 to its triggering position 303 in which the dead-center position of the catch element 11 will be overcome—as shown in FIG. 7*d*. That triggering position 303 is already at a spacing D relative to the front edge 300 of the drawer side wall of more than 25 mm. In this specific example that distance is 30.8 mm.

The triggering travel—from the introduction position 302 to the triggering position 303—is 1 mm.

FIG. 7*e* now shows how the spring 17 has pivoted the catch element of the catch device 10 and has thereby pulled the pin 23 of the furniture fitting 20 into the catch device 10—as far as its closure position 304. That closure position 304 is already at a spacing E relative to the front edge 300 of the drawer side wall of more than 30 mm. In this specific embodiment that distance is 35.8 mm.

The closure travel—from the triggering position 303 to the closure position 304—is 5 mm.

In FIG. 7*f*, the pin 23 of the furniture fitting 20 is in its closure reserve position which is already at a spacing of more than 35 mm relative to the front edge 300 of the drawer side wall. In this specific embodiment, this distance is already 37.8 mm.

The closure reserve travel—from the closure position 304 to the closure reserve position 305—is 2 mm.

FIGS. 8*a* through 8*g* now show the above-mentioned positions and travels on the novel fixing device 1.

Figure 8B:
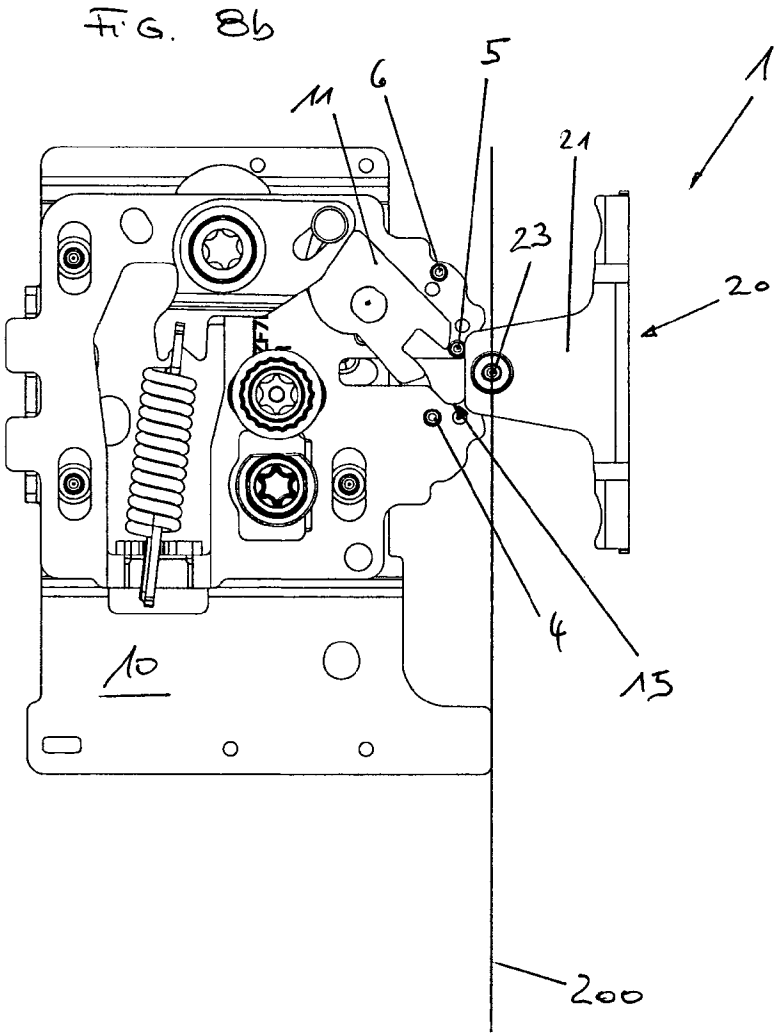
FIGS. 8*a*-8*g* show plan views of the fixing operation at different positions of the furniture fitting relative to the catch device.
Figure 8A:
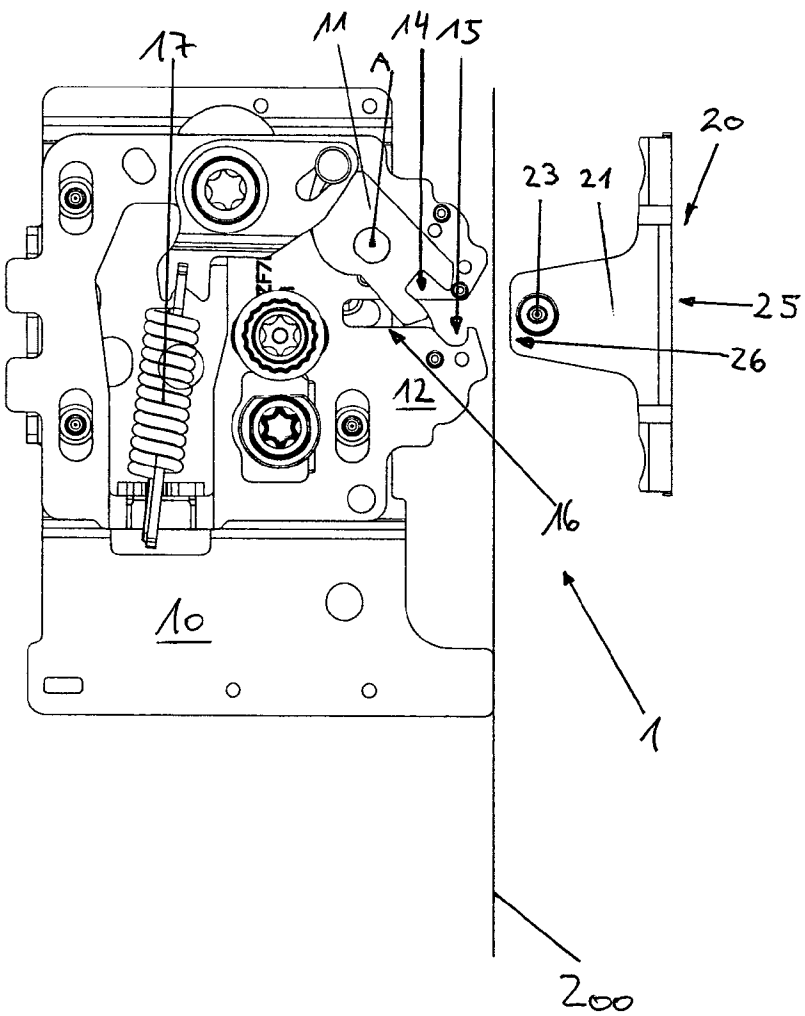

FIG. 8*a* shows the fixing device 1 in which its furniture fitting 20 and its pin 23 which extends transversely to the insertion direction have not yet reached the front edge 200 of the drawer side wall.

Provided in the catch device 10 is the spring 17 which can pivot the catch element 11 about its axis of rotation A by a lever mechanism as soon as the pin 23 of the furniture fitting 20 is in the catch opening 14 of the catch element 11 and triggers pivotal movement of the catch element 11.

The catch device 10 further has the guide plate 12 which has an introduction passage in which the latching opening 15 is provided in its front region and the guide path 16 for the pin 23 of the furniture fitting 20 is provided in its rear region.

It can again be clearly seen from this view of the furniture fitting 20 that the spacing of the free end 26 of the legs 21 and 22 from the rear side 25 of the furniture fitting 20, that is towards the front panel, is greater than the spacing of the pin 23 from the rear side 25 of the furniture fitting 20, that is towards the front panel (see in that respect the specific description of FIGS. 5*a* and 5*b*).

Figures 8C, 8D:
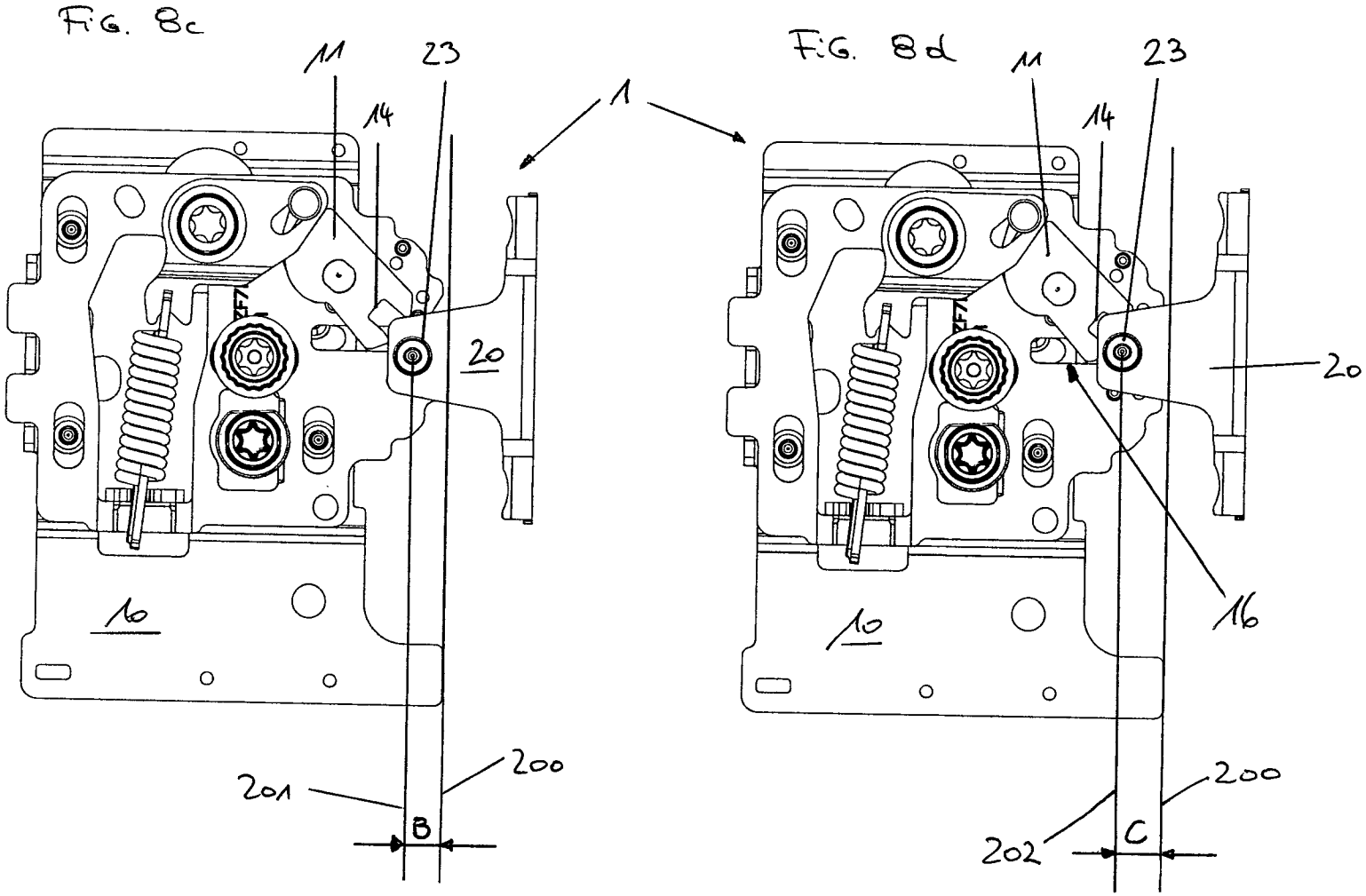

In FIG. 8*b*, the pin 23 of the furniture fitting 20 is at the position of the front edge 200 of the drawer side wall and is inserted into the latching opening 15 in the next step, as shown in FIG. 8*c*. In order to avoid any erroneous triggering of the catch element 11 of the catch device 10, the guide plate 12 has laterally projecting deflection elements 4, 5 and 6 which prevent the leg 21 of the furniture fitting 20 from being able to come into contact with the catch element 11 of the catch device 10—which would cause erroneous triggering.

Accordingly, the furniture fitting 20 can only be correctly inserted into the catch device 10 and pass into the latching position 201 in the latching receiving opening 15.

That latching position 201 is at a spacing B relative to the front edge 200 of the drawer side wall of less than 15 mm, preferably less than 10 mm, wherein in this specific embodiment the distance is 3.8 mm.

The latching travel—from the front edge 200 of the drawer side wall to the latching position 201—is 3.8 mm.

FIG. 8*d* now shows how the furniture fitting 20 and its pin 23 have been advanced into the introduction passage of the catch device 10 to such an extent that it has reached its introduction position 202 in which the pin 23 is already in the catch opening 14 of the catch element 11 of the catch device 10 but the catch element 11 has not yet moved.

That introduction position 202 is at a spacing C relative to the front edge 200 of the drawer side wall of less than 25 mm, preferably less than 10 mm, in this specific embodiment the distance is 4.2 mm. If for that purpose the introduction position in the fixing device belonging to the state of the art and described in FIG. 7*c* is compared thereto it will be seen that its introduction position is at a spacing C which is more than 7 times as great as in the present novel fixing device as described in FIG. 8*d*.

The introduction travel—from the front edge 200 of the drawer side wall to the introduction position 202—is 4.2 mm. In the state of the art, the introduction travel was 37.8 mm (see the specific description relating to FIG. 7*c*).

Figures 8E, 8F:
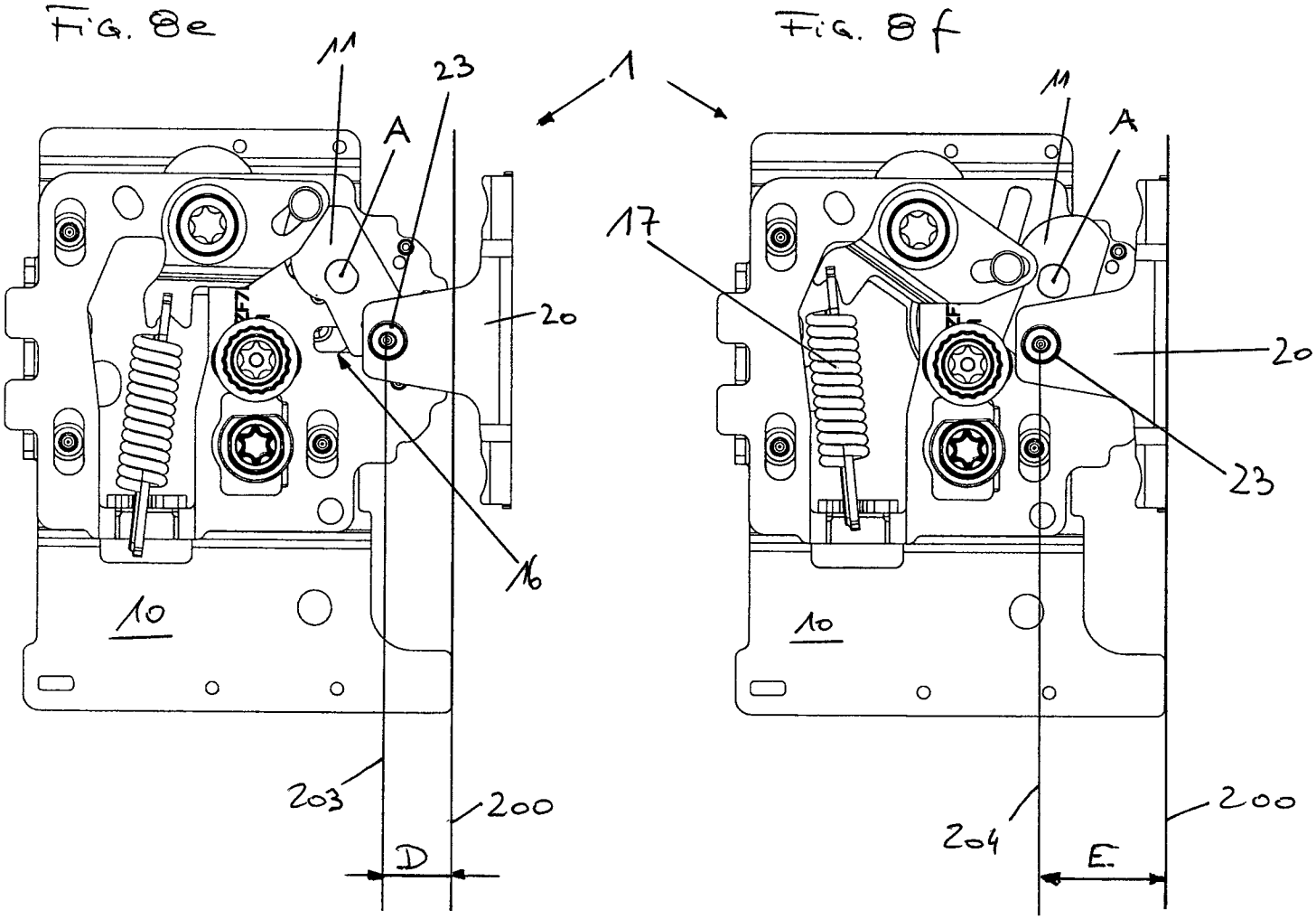

FIG. 8*e* shows how the pin 23 of the furniture fitting 20 is disposed in the triggering position 203 in which the catch element 11 is pivoted about its axis of rotation A by the spring 17 of the catch device 10 at the lever mechanism thereof and thereupon pulls the pin 23 of the furniture fitting 20 into the catch device 10—as shown in FIG. 8*f*.

In that respect the triggering position 203 is at a spacing D relative to the front edge 200 of the drawer side wall of less than 25 mm, preferably less than 10 mm, in this specific embodiment this distance is even only 7.4 mm. In comparison therewith—as described in FIG. 7*d*—the triggering position in the case of the fixing device belonging to the state of the art is already spaced at more than 30 mm relative to the front edge 300 of the drawer side wall (spacing D).

The triggering travel—from the introduction position 202 to the triggering position 203—is 3.2 mm. In the state of the art, in contrast, the triggering travel was only 1 mm (see the specific description of FIG. 7*d*).

After the spring 17 has pivoted the catch element 11 about its axis of rotation A and has pulled the pin 23 of the furniture fitting 20 into the catch device 10, the pin 23 is in its closure position. In that closure position, the pin 23 is at a spacing E relative to the front edge 200 of the drawer side wall of less than 30 mm, preferably less than 20 mm. In this specific embodiment, this distance even involves only 14.6 mm. If the closure position 304 of the fixing device belonging to the state of the art is compared thereto, as shown in FIG. 7*e*, it will be seen that this spacing E is more than 20 mm greater than in the present fixing device 1.

The closure travel—from the triggering position 203 to the closure position 204—is 7.2 mm. In the state of the art, in contrast, the closure travel was 5 mm (see the specific description of FIG. 7*e*).

Figure 8G:
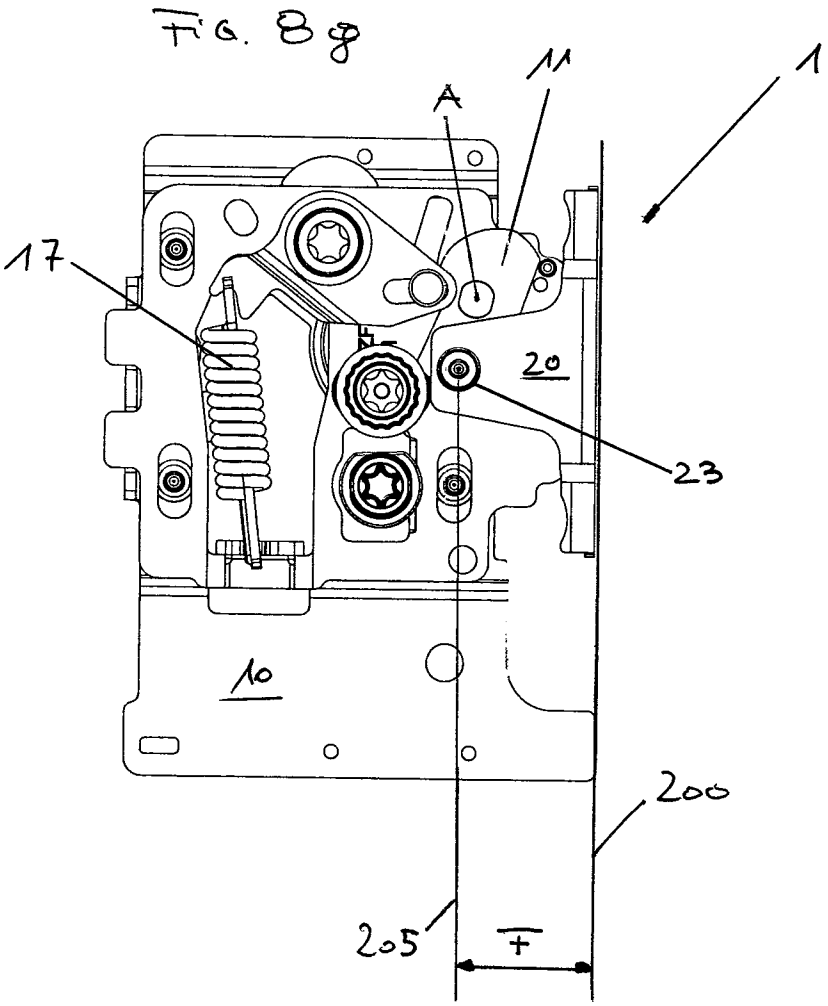

FIG. 8*g* now shows the closure reserve position 205 in which the pin 23 of the furniture fitting 20 is at a spacing F relative to the front edge 200 of the drawer side wall and which is also less than 30 mm—preferably less than 20 mm. In this specific embodiment it is exactly 15 mm, which is less than half of that which the fixing device belonging to the state of the art requires (see the description of FIG. 7*f*, spacing F: 37.8 mm). The closure reserve serves to be able to compensate for dimensional tolerances.

The closure reserve travel—from the closure position 204 to the closure reserve position 205—is 0.4 mm. In the state of the art the closure reserve travel in contrast was 2 mm (see the specific description of FIG. 7*f*).

This means that the present fixing device 1 is much more compact than the fixing devices belonging to the state of the art.

The invention claimed is:

1. A fixing device for fixing a front panel to a drawer side wall, said fixing device comprising:
   - a furniture fitting to be mounted to the front panel, said furniture fitting having a leg to project from the front panel, said leg having a free end and a pin extending transversely relative to said leg; and
   - a catch device to be mounted to the drawer side wall, said catch device being configured to receive and automatically hold said furniture fitting to be pushed into said catch device, said catch device including:
     - at least two catch elements including a movable spring-loaded first catch element with a catch opening, said spring-loaded first catch element being configured to be triggered by insertion of said pin into said catch opening so as to hold said pin;
     - a guide plate along which said first catch element is movable, each of said at least two catch elements being plate-shaped and parallel to said guide plate, said at least two catch elements being arranged to slide along opposite sides of said guide plate respectively; and
     - at least two deflection elements located at said opposite sides of said guide plate, respectively, and configured to abut against said leg of said furniture fitting, a first one of said at least two deflection elements comprising a projection projecting laterally from a first one of said opposite sides of said guide plate;
   - wherein said furniture fitting and said catch device are configured such that, when said furniture fitting is inserted into said catch device, at least said first one of said at least two deflection elements contacts said leg of said furniture fitting to prevent contact of said free end of said leg of said furniture fitting with said first catch element while simultaneously allowing movement of said pin of said furniture fitting into said catch opening of said first catch element.

2. The fixing device according to claim 1, further comprising an unlocking device configured to permit intended release of said furniture fitting from said catch device, said unlocking device being configured to release said first catch element and said pin of said furniture fitting.

3. The fixing device according to claim 2, wherein said unlocking device has a tool receiving element for allowing actuation of said unlocking device, said tool receiving element being configured to receive a tool and being accessible from outside said fixing device.

4. The fixing device according to claim 1, wherein said projection is formed as a knob.

5. The fixing device according to claim 1, wherein said projection has a height at least as large as a thickness of said first catch element.

6. The fixing device according to claim 1, wherein a distance equal to a height of said projection together with a width of said guide plate is at least as large as a width of an internal space of said furniture fitting.

7. The fixing device according to claim 1, wherein a second one of said at least two deflection elements is formed as a nose.

8. The fixing device according to claim 1, wherein said at least two deflection elements comprises at least four deflection elements including at least two deflection elements formed as a nose and at least two deflection elements formed as projections projecting laterally from said guide plate.

9. The fixing device according to claim 1, wherein said at least two deflection elements at said opposite sides of said guide plate are projections, a total distance including a total height of said at least two projections at said opposite sides of said guide plate together with a width of said guide plate is at least as large as a width of an internal space of said furniture fitting.

10. The fixing device according to claim 1, wherein said first catch element has a free end, and said catch opening is located at said free end of said first catch element.

11. The fixing device according to claim 1, wherein said first catch element is mounted pivotably about an axis of rotation.

12. The fixing device according to claim 1, further comprising at least one of a height adjusting device and a lateral adjusting device for adjusting a position of said furniture fitting on the front panel.

13. The fixing device according to claim 1, wherein a distance between said free end of said leg of said furniture fitting and a rear side of said furniture fitting is greater than a distance between said pin of said furniture fitting and said rear side of the furniture fitting.

14. A drawer side wall comprising:

said fixing device of claim 1 for fixing the front panel to a drawer.

15. The drawer side wall according to claim 14, wherein said furniture fitting and said catch device are configured such that said pin of said furniture fitting latches in a latching receiving opening of said catch device in a latching position located at a distance of less than 15 mm from a front edge of the drawer side wall.

16. The drawer side wall according to claim 15, wherein said furniture fitting and said catch device are configured such that a latching travel from the front edge of the drawer side wall to the latching position is less than 15 mm.

17. The drawer side wall according to claim 14, wherein said furniture fitting and said catch device are configured such that said pin of said furniture fitting is in said catch opening of said first catch element of said catch device in an introduction position located at a distance of less than 25 mm from a front edge of the drawer side wall.

18. The drawer side wall according to claim 17, wherein said furniture fitting and said catch device are configured such that an introduction travel from the front edge of the drawer side wall to the introduction position is less than 25 mm.

19. The drawer side wall according to claim 14, wherein said furniture fitting and said catch device are configured such that said pin of said furniture fitting triggers said first catch element of said catch device in a triggering position located at a distance of less than 25 mm from a front edge of the drawer side wall.

20. The drawer side wall according to claim 19, wherein said furniture fitting and said catch device are configured such that a triggering travel from an introduction position in which said pin of said furniture fitting is in said catch opening of said first catch element of said catch device to the triggering position is greater than 1.5 mm.

21. The drawer side wall according to claim 14, wherein said furniture fitting and said catch device are configured such that said pin of said furniture fitting is pulled by said first catch element of said catch device into said catch device in a closure position located at a distance of less than 30 mm from a front edge of the drawer side wall.

22. The drawer side wall according to claim 21, wherein said furniture fitting and said catch device are configured such that a closure travel from a triggering position in which said pin of said furniture fitting triggers said first catch element of said catch device to the closure position is greater than 6 mm.

23. The drawer side wall according to claim 14, wherein said furniture fitting and said catch device are configured such that said pin of said furniture fitting is pulled by said first catch element of said catch device into said catch device beyond a closure position into said catch device in a closure reserve position located at a distance of less than 30 mm from a front edge of the drawer side wall.

24. The drawer side wall according to claim 23, wherein said furniture fitting and said catch device are configured such that a closure reserve travel from the closure position in which said pin of said furniture fitting is pulled by said first catch element of said catch device into said catch device to the closure reserve position is less than 2 mm.

25. A drawer comprising at least one drawer side wall according to claim 14.

26. An article of furniture comprising at least one drawer according to claim 25.

* * * * *